US008714057B2

(12) United States Patent
Anjanappa et al.

(10) Patent No.: US 8,714,057 B2
(45) Date of Patent: May 6, 2014

(54) RATCHETING DEVICE FOR AN ELECTRONIC TORQUE WRENCH

(75) Inventors: Muniswamappa Anjanappa, Ellicott City, MD (US); Xia Chen, Columbia, MD (US); Nitin Bedi, Houston, TX (US)

(73) Assignee: Apex Brands, Inc., Sparks, MD (US)

( * ) Notice: Subject to any disclaimer, the term of this patent is extended or adjusted under 35 U.S.C. 154(b) by 500 days.

(21) Appl. No.: 12/981,617

(22) Filed: Dec. 30, 2010

(65) Prior Publication Data

US 2011/0162493 A1 Jul. 7, 2011

Related U.S. Application Data

(60) Provisional application No. 61/292,119, filed on Jan. 4, 2010.

(51) Int. Cl.
*B25B 23/14* (2006.01)
*B25B 23/144* (2006.01)
*B25B 23/159* (2006.01)

(52) U.S. Cl.
USPC ..... 81/479; 81/467

(58) Field of Classification Search
USPC ..... 81/467, 479, 173; 73/862.23
See application file for complete search history.

(56) References Cited

U.S. PATENT DOCUMENTS

| | | | |
|---|---|---|---|
| 2,303,411 | A | 12/1942 | Van Horn |
| 2,682,796 | A | 7/1954 | Larson |
| 2,732,747 | A | 1/1956 | Livermont |
| 2,934,946 | A | 5/1960 | Engquist |
| 3,670,602 | A | 6/1972 | Van Hoose |
| 3,722,316 | A | 3/1973 | Hawkins et al. |
| 3,726,134 | A | 4/1973 | Grabovac |
| 3,847,038 | A | 11/1974 | Green |
| 3,911,736 | A | 10/1975 | Miller |
| 3,921,471 | A | 11/1975 | Smith |
| 3,995,477 | A | 12/1976 | Almond |
| 4,244,434 | A | 1/1981 | Wilson |
| 4,262,528 | A | 4/1981 | Holting et al. |
| 4,290,329 | A | 9/1981 | Green |
| 4,397,196 | A | 8/1983 | Lemelson |
| 4,485,703 | A | 12/1984 | Grabovac et al. |
| 4,558,601 | A | 12/1985 | Stasiek et al. |
| 4,561,332 | A | 12/1985 | Wood |

(Continued)

FOREIGN PATENT DOCUMENTS

| | | |
|---|---|---|
| DE | 3128557 | 3/1983 |
| DE | 4235954 | 5/1993 |

(Continued)

*Primary Examiner* — Hadi Shakeri
*Assistant Examiner* — Danny Hong
(74) *Attorney, Agent, or Firm* — Nelson Mullins Riley & Scarborough, LLP

(57) ABSTRACT

An electronic torque wrench including a wrench body, a wrench head configured to engage a workpiece, a first sensor producing a first output signal, that is proportional to an amount of torque being applied to the workpiece, a grip handle, a second sensor producing a second output signal that is proportional to an amount of rotation being applied to the workpiece, a user interface including an input device for inputting a preset torque value, and a processor for converting the first output signal into a current torque value, comparing the current torque value to the preset torque value, and converting the second output signal into a first angle value through which the workpiece has been rotated after the current torque value exceeds the preset torque value.

21 Claims, 14 Drawing Sheets

(56) References Cited

U.S. PATENT DOCUMENTS

| | | | | |
|---|---|---|---|---|
| 4,602,538 | A | 7/1986 | Neuhaus | |
| 4,664,001 | A | 5/1987 | Denman | |
| 4,669,319 | A | 6/1987 | Heyraud | |
| 4,805,464 | A | 2/1989 | Grabovac | |
| 4,864,841 | A | 9/1989 | Heyraud | |
| 4,958,541 | A | 9/1990 | Annis et al. | |
| 4,982,612 | A | 1/1991 | Rittmann | |
| 5,130,700 | A | 7/1992 | Annis et al. | |
| 5,156,072 | A | 10/1992 | Muralidharan | |
| 5,172,616 | A | 12/1992 | Negishi | |
| 5,224,403 | A | 7/1993 | Rueb | |
| 5,497,682 | A | 3/1996 | Hsu | |
| 5,537,877 | A | 7/1996 | Hsu | |
| 5,557,994 | A | 9/1996 | Nakayama | |
| 5,581,042 | A | 12/1996 | Tambini | |
| 5,589,644 | A | 12/1996 | Becker et al. | |
| 6,070,506 | A | 6/2000 | Becker | |
| 6,109,150 | A | 8/2000 | Saccomanno, III | |
| 6,463,811 | B1 | 10/2002 | Putney | |
| 6,526,853 | B2 | 3/2003 | Jenkins | |
| 6,568,283 | B2 | 5/2003 | Fanguy | |
| 6,722,235 | B2 | 4/2004 | Hsieh | |
| 6,796,190 | B2 | 9/2004 | Curry | |
| 6,920,811 | B2 | 7/2005 | Hsien | |
| 6,968,759 | B2 | 11/2005 | Becker et al. | |
| 6,981,436 | B2 | 1/2006 | Becker et al. | |
| 7,000,508 | B2 | 2/2006 | Li et al. | |
| 7,013,737 | B2 | 3/2006 | Hsien | |
| 7,044,036 | B1 | 5/2006 | Salazar et al. | |
| 7,047,849 | B2 | 5/2006 | Lai | |
| 7,062,978 | B1 | 6/2006 | Hsien | |
| 7,069,827 | B1 | 7/2006 | Hsieh | |
| 7,082,866 | B2 * | 8/2006 | Becker | 81/479 |
| 7,104,144 | B1 | 9/2006 | Hsieh | |
| 7,107,884 | B2 | 9/2006 | Cutler et al. | |
| 7,137,323 | B1 | 11/2006 | Hsieh | |
| 7,168,349 | B1 | 1/2007 | Hsieh | |
| 7,168,350 | B1 | 1/2007 | Hsieh | |
| 7,174,817 | B1 | 2/2007 | Hsieh | |
| 7,182,005 | B1 | 2/2007 | Hsieh | |
| 7,185,571 | B1 | 3/2007 | Hsieh | |
| 2005/0072278 | A1 * | 4/2005 | Cutler et al. | 81/467 |
| 2005/0126351 | A1 * | 6/2005 | Becker et al. | 81/479 |
| 2005/0183513 | A1 | 8/2005 | Hsien | |
| 2005/0263000 | A1 | 12/2005 | Hill | |
| 2006/0027058 | A1 | 2/2006 | Hsien | |
| 2007/0119267 | A1 | 5/2007 | Anjanappa et al. | |
| 2007/0119268 | A1 | 5/2007 | Escoe et al. | |
| 2007/0119269 | A1 | 5/2007 | Anjanappa et al. | |
| 2007/0144270 | A1 | 6/2007 | Crass et al. | |

FOREIGN PATENT DOCUMENTS

| | | |
|---|---|---|
| DE | 29724239 | 8/2000 |
| FR | 2633544 | 1/1990 |
| WO | WO 03013797 | 2/2003 |
| WO | WO 03041914 | 5/2003 |

* cited by examiner

RATCHETING DEVICE FOR AN ELECTRONIC TORQUE WRENCH

CLAIM OF PRIORITY

This application claims priority to U.S. Provisional Patent Application No. 61/292,119 filed Jan. 4, 2010, the entire disclosure of which is hereby incorporated by reference herein.

FIELD OF THE INVENTION

The present invention relates generally to torque application and measurement devices. More particularly, the present invention relates to a ratcheting electronic torque wrench.

BACKGROUND OF THE INVENTION

Often, fasteners used to assemble performance critical components are tightened to a specified torque level to introduce a "pretension" in the fastener. As torque is applied to the head of the fastener, the fastener may begin to stretch beyond a certain level of applied torque. This stretch results in the pretension in the fastener which then holds the components together. Additionally, it is often necessary to further rotate the fastener through a specified angle after the desired torque level has been applied. A popular method of tightening these fasteners is to use a torque wrench.

Torque wrenches may be of mechanical or electronic type. Mechanical torque wrenches are generally less expensive than electronic. There are two common types of mechanical torque wrenches, beam and clicker types. In a beam type torque wrench, a beam bends relative to a non-deflecting beam in response to applied torque. The amount of deflection of the bending beam relative to the non-deflecting beam indicates the amount of torque applied to the fastener. Clicker type torque wrenches have a selectably preloaded snap mechanism with a spring to release at a specified torque, thereby generating a click noise.

Electronic torque wrenches (ETWs) tend to be more expensive than mechanical torque wrenches. When applying torque to a fastener with an electronic torque wrench, the torque readings indicated on the display device of the electronic torque wrench relate to the pretension in the fastener due to the applied torque. Some ETWs are also capable of measuring angular rotation of the wrench, and therefore the fastener, in addition to measuring the amount of torque initially applied to the fastener. However, fasteners are often positioned such that both the torque and the desired additional angular rotation may not be applied with the torque wrench in a single, continuous motion. In such cases, an electronic torque wrench having a ratcheting feature can be used.

An electronic torque wrench capable of angle measurement during ratcheting operations may begin measuring and accumulating the angular rotation of the ETW the moment the user begins to rotate the ETW. The instant initiation of angular measurement can lead to inaccuracies due to "play" found in the wrench's ratcheting mechanism that causes the ETW to rotate slightly prior to the actual rotation of the fastener. These inaccuracies are compounded where the angular rotation cannot be achieved in a single rotary motion of the ETW. Consider, for example, if such an ETW rated for 100 ft-lbs is used to rotate a fastener through a 90° angle, wherein the fastener's position restricts the ETW's rotation to 30° and the accumulation of the angular rotation begins immediately upon the ETW's rotation. As shown in the graph of FIG. 1A, as the first 30° of rotation subsequent to reaching the previously-applied target torque, that being 10 ft-lbs in the present example, are applied to the fastener, the amount of the ETW's angular rotation is measured from 0 ft-lbs of torque up to the maximum torque applied to the fastener during the first cycle, for example 20 ft-lbs. The ETW's measured angular rotation during the first cycle is represented by the entire solid line portion of the graph, indicated by portions 102 and 103. Because the fastener will only rotate after the ETW exceeds the previously-applied torque of 10 ft-lbs, angular rotation should only be measured and accumulated for solid line portion 102, as any angular rotation measured over solid line portion 103 is merely due to "play" in the ratcheting mechanism, deflection of the ETW body, etc.

In the second cycle, the ETW rotates through an additional 30°, reaching a new maximum torque value of 50 ft-lbs. As in the first cycle, the angular rotation measurement begins immediately upon the ETW's rotation. However, the fastener does not actually rotate until the ETW reaches the previous cycle's maximum applied torque of 20 ft-lbs. As such, any deflection of the ETW unit or play in the ratcheting mechanism that may occur between 0 ft-lbs and 20 ft-lbs, as represented by portion 105 of the graph, is erroneously added to the accumulated angular rotation value, whereas angular rotation should only be accumulated between 20 ft-lbs and 50 ft-lbs, as represented by portion 104 of the graph. Similarly, for the third cycle, any deflection of the ETW unit or play in the ratcheting mechanism that may occur between 0 ft-lbs and the previous cycle's maximum applied torque of 50 ft-lbs, as represented by portion 107 of the graph, is erroneously added to the accumulated angular rotation value, whereas angular rotation should only be accumulated between 50 ft-lbs and 100 ft-lbs, as represented by portion 106 of the graph. Similar inaccuracies can occur with each subsequent ratcheting cycle.

To help prevent inaccuracies due to play in the ETW's ratcheting mechanism, deflection of the ETW body, etc., some ETWs begin measuring and accumulating angular rotation at a fixed percentage of the torque wrench's rated capacity, such as 5%. Using such a fixed percentage to initiate angular measurement can also lead to inaccuracy, however, where a desired angular rotation cannot be achieved in a single rotary motion of the ETW. Consider, for example, if such an ETW rated for 100 ft-lbs is used to rotate a fastener through a 90° angle, wherein the fastener's position restricts the ETW's rotation to 30° and the accumulation of the fastener's angular rotation begins only after the ETW applies 5 ft-lbs of torque (i.e. 5% of its rated capacity). As shown in the graph of FIG. 1B, as the ETW rotates the first 30° subsequent to reaching the previously-applied target torque, that being 10 ft-lbs in the present example, the ETW measures angular rotation from 5 ft-lbs of torque up to a maximum torque applied during the first cycle, for example 20 ft-lbs. The fastener's angular rotation during the first cycle is represented by the solid line portion of the graph, indicated by 112. Unlike the example shown in FIG. 1A, the 5 ft-lbs threshold for measuring and accumulating angular rotation helps prevent some of the inaccuracies in angle accumulation during the first ratcheting cycle, more specifically, those that occur between 0 ft-lbs and 5 ft-lbs. However, the ETW begins measuring angular rotation at the 5 ft-lbs threshold, whereas the fastener does not actually rotate until the ETW reaches the previously-applied target torque of 10 ft-lbs. As such, the ETW erroneously accumulates any deflection that may occur between the previously-applied torque of 10 ft-lbs and the 5 ft-lbs threshold, as represented by portion 113 of the graph.

In the second cycle, the ETW rotates through an additional 30°, reaching a new maximum torque value at 50 ft-lbs. As in the first cycle, the ETW begins measuring angular rotation at 5 ft-lbs of applied torque. However, the fastener does not actually rotate until the ETW reaches the previous cycle's maximum applied torque of 20 ft-lbs. As such, the ETW erroneously accumulates any deflection that may occur between the applied torques of 5 ft-lbs and 20 ft-lbs, as represented by portion 115 of the graph, whereas angular rotation should only be accumulated between 20 ft-lbs and 50 ft-lbs, as represented by portion 114. Similarly, for the third cycle, the ETW erroneously accumulates any deflection of the ETW that may occur between the applied torque of 5 ft-lbs and the previous cycle's maximum applied torque of 50 ft-lbs, as represented by portion 117 of the graph, whereas angular rotation should only be accumulated between 50 ft-lbs and 100 ft-lbs, as represented by portion 116. Similar inaccuracies can occur with each subsequent ratcheting cycle.

The present invention recognizes and addresses certain or all of the foregoing considerations, and others, of prior art constructions and methods.

SUMMARY OF THE INVENTION

One embodiment of the present invention provides an electronic torque wrench for engaging a workpiece, including a wrench body, a wrench head disposed on the wrench body, the wrench head being configured to engage the workpiece, a first sensor operatively coupled to the wrench head and producing a first output signal, the first output signal being proportional to an amount of torque being applied to the workpiece by the torque wrench, a grip handle disposed on the wrench body opposite the wrench head, a second sensor operatively coupled to the wrench body and producing a second output signal, the second output signal being proportional to an amount of rotation being applied to the workpiece by the torque wrench, a user interface carried by the wrench body, the user interface including a digital display with a first readout and an input device for inputting a preset torque value, and a processor for converting the first output signal into a current torque value being applied to the workpiece, comparing the current torque value to the preset torque value, and converting the second output signal into a first angle value through which the workpiece has been rotated after the current torque value exceeds the preset torque value.

Another embodiment of the present invention provides an electronic torque wrench for engaging a workpiece, including a wrench body, a wrench head disposed on the wrench body, the wrench head being configured to engage the workpiece, a ratcheting mechanism so that torque can be applied to the workpiece using multiple rotational cycles of the torque wrench, a strain gage assembly operatively coupled to the wrench head and producing a first output signal, the first output signal being proportional to an amount of torque being applied to the workpiece by the torque wrench, a grip handle disposed on the wrench body opposite the wrench head, a gyroscopic sensor operatively coupled to the wrench body and producing a second output signal, the second output signal being proportional to an amount of rotation being applied to the workpiece by the torque wrench, a user interface carried by the wrench body, the user interface including an input device for inputting a preset torque value, and a processor for converting the first output signal into a current torque value being applied to the workpiece, comparing the current torque value to the preset torque value, and converting the second output signal into a first angle value through which the workpiece has been rotated after the current torque value exceeds the preset torque value.

The accompanying drawings, which are incorporated in and constitute a part of this specification, illustrate one or more embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended drawings, in which.

Figure 1A:
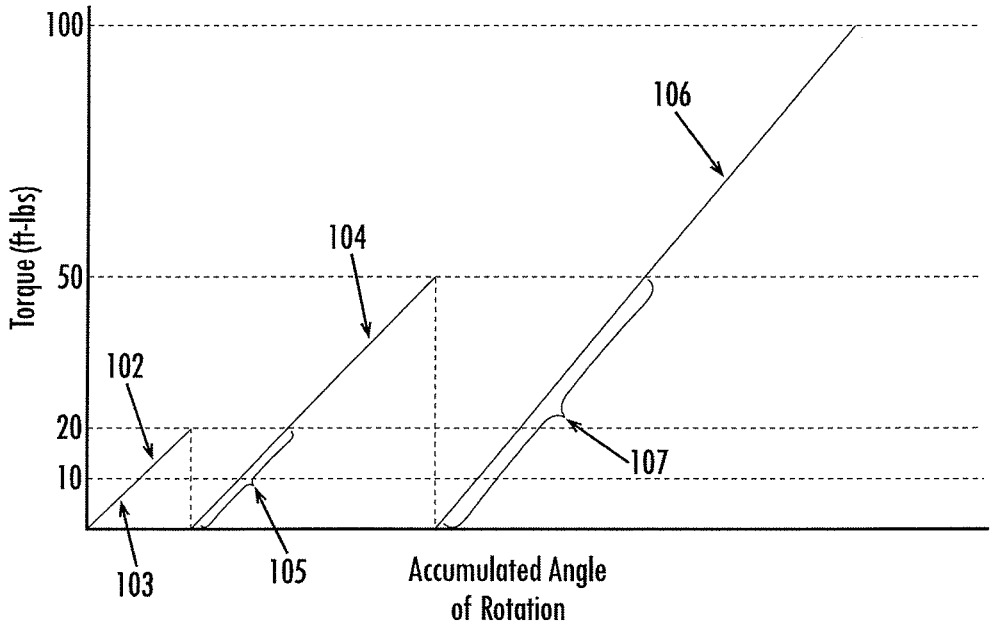
Fig. 1A (Prior Art)
FIGS. 1A and 1B are graphical representations of the accumulation of angular rotation of a fastener using prior art ratcheting electronic torque wrench methods.
Figure 1B:
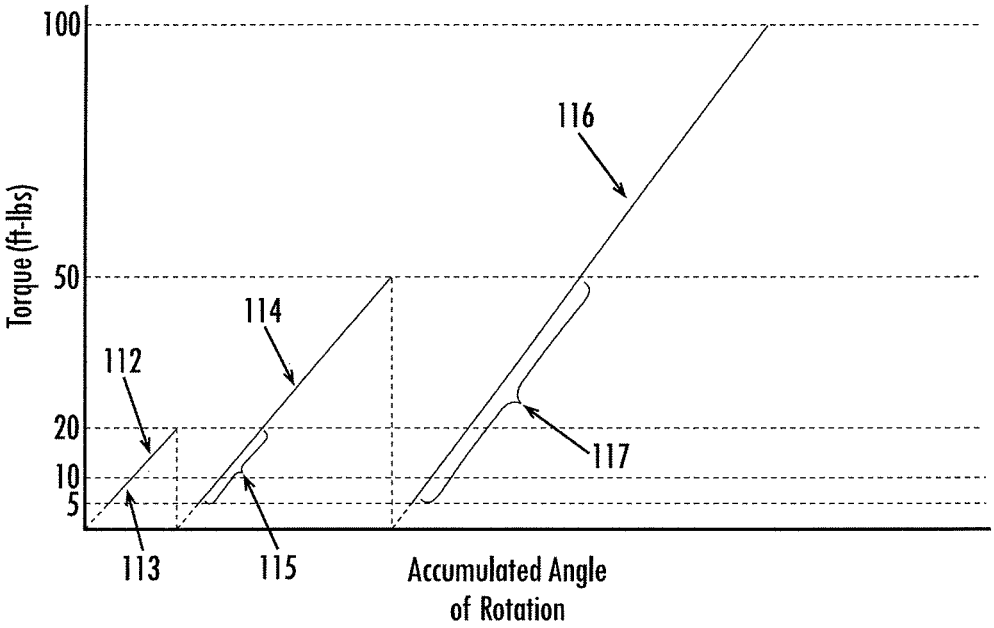
Fig. 1B (Prior Art)

Repeat use of reference characters in the present specification and drawings is intended to represent same or analogous features or elements of the invention according to the disclosure.

DETAILED DESCRIPTION OF THE PREFERRED EMBODIMENTS

Reference will now be made in detail to presently preferred embodiments of the invention, one or more examples of which are illustrated in the accompanying drawings. Each example is provided by way of explanation, not limitation, of the invention. In fact, it will be apparent to those skilled in the art that modifications and variations can be made in the present invention without departing from the scope and spirit thereof. For instance, features illustrated or described as part of one embodiment may be used on another embodiment to yield a still further embodiment. Thus, it is intended that the present invention covers such modifications and variations as come within the scope of the appended claims and their equivalents.

Figure 2:
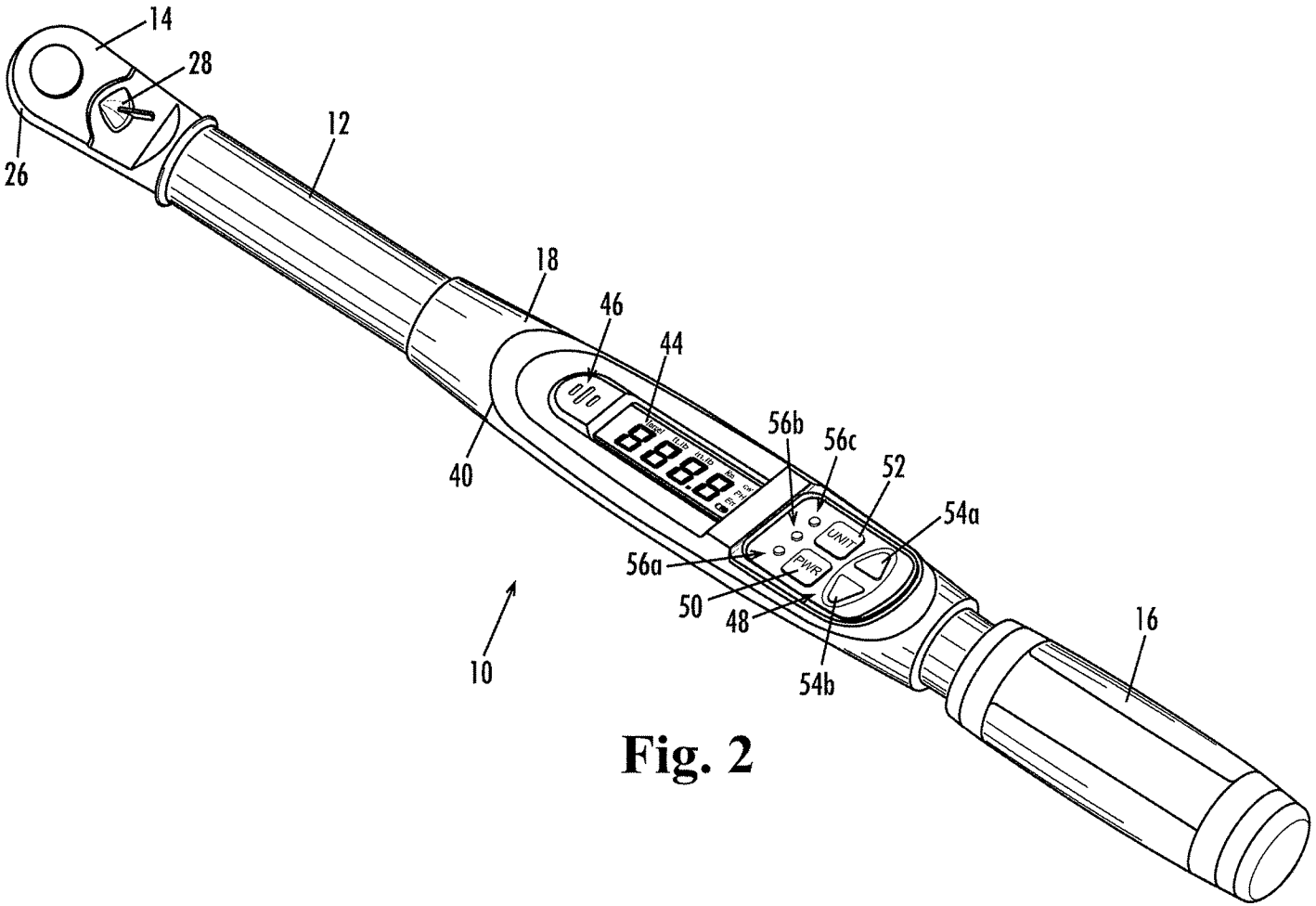
FIG. 2 is a perspective view of a preferred embodiment of an electronic torque wrench in accordance with the present invention.
Figure 3:
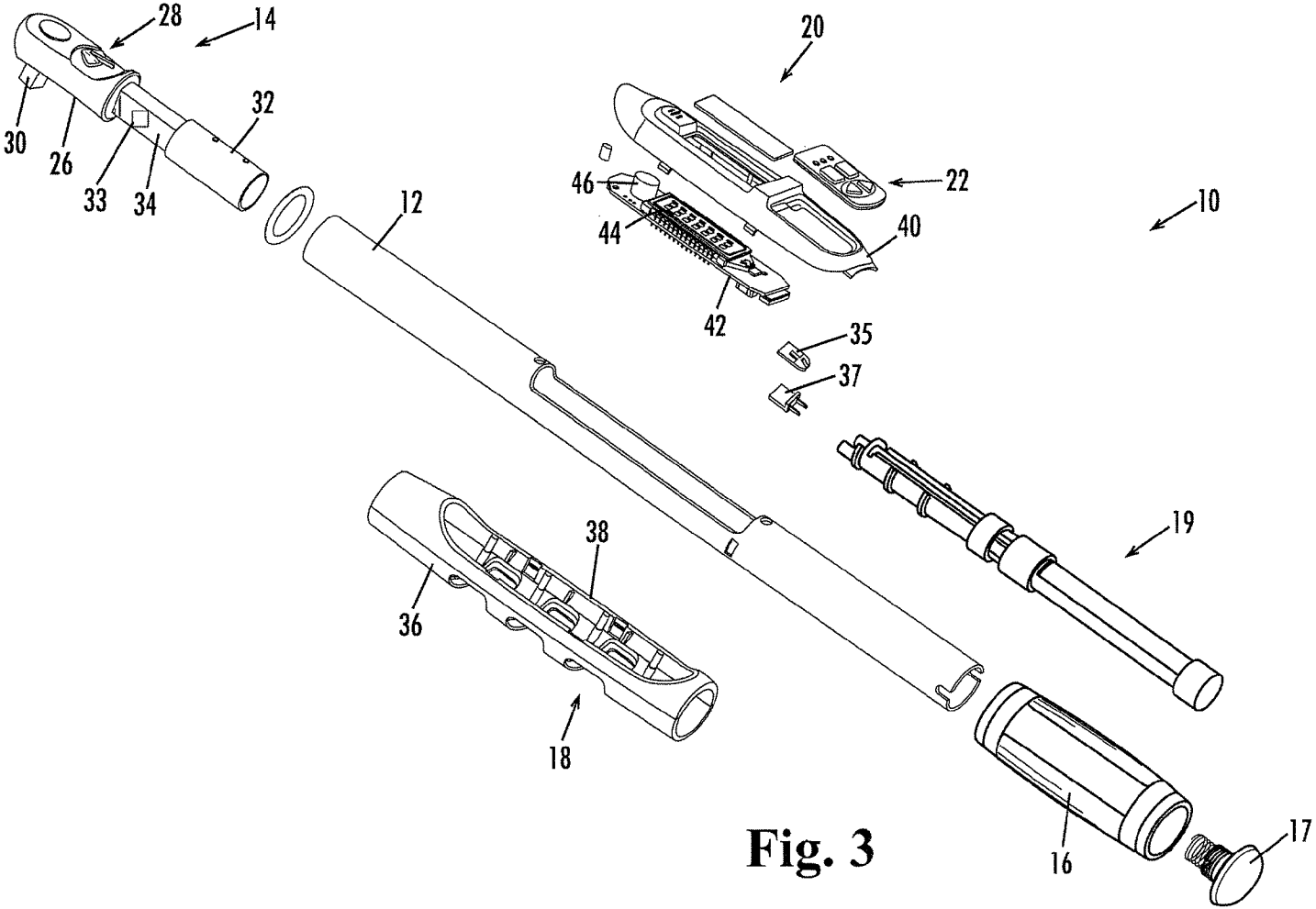
FIG. 3 is an exploded perspective view of the electronic torque wrench as shown in FIG. 2.

Referring now to FIGS. 2 and 3, a ratcheting electronic torque wrench 10 has a torque and angle measurement sensor and display device in accordance with an embodiment of the present invention. Electronic torque wrench 10 includes a wrench body 12, a ratchet/wrench head 14, a grip handle 16, a housing 18, a battery assembly 19, and an electronics unit 20 with a user interface 22. Preferably, wrench body 12 is of tubular construction, made of steel or other rigid material, and receives wrench head 14 at a first end and battery assembly 19 at a second end, secured therein by an end cap 17. Housing 18 is mounted therebetween and carries electronics unit 20.

As shown, a front end 26 of wrench head 14 includes a ratcheting coupler with a lever 28 that allows a user to select whether torque is applied to a fastener in either a clockwise (CW) or counter-clockwise (CCW) direction. The ratcheting mechanism includes a boss 30 for receiving variously sized sockets, extensions, etc. A rear end 32 of wrench head 14 is slidably received in wrench body 12 and rigidly secured therein. Wrench head 14 includes at least one vertical flat portion 34 formed between front and rear ends 26 and 32 for receiving a strain gage assembly 33. Flat portion 34 is both transverse to the plane of rotation of torque wrench 10 and parallel to the longitudinal center axis of wrench head 14. In the embodiment shown, strain gage assembly 33 is a full-bridge assembly including four separate strain gages on a single film that is secured to flat portion 34 of wrench head 14. An example of one such full-bridge strain gage assembly is Model No. N2A-S1449-1 KB manufactured by Vishay Micromeasurement, Malvern, Pa., U.S. Together, the full-bridge strain gage assembly mounted on flat portion 34 of wrench head 14 is referred to as a strain tensor. Additionally, a gyroscopic sensor 35 is mounted in electronic torque wrench 10 on a printed circuit board 37. Gyroscopic sensor 35 is preferably a MEMS gyroscopic sensor, such as Model No. XV3500 manufactured by EPSON, Tokyo, Japan. However, other sensors that are capable of strain and angular measurement may also be used.

Housing 18 includes a bottom portion 36 that is slidably received about wrench body 14 and defines an aperture 38 for receiving a top portion 40 that carries electronics unit 20. Electronics unit 20 provides a user interface 22 for the operation of the electronic torque wrench. Electronics unit 20 includes a printed circuit board 42 including a digital display 44 and an annunciator 46 mounted thereon. Top housing portion 40 defines an aperture that receives user interface 22. User interface 22 includes a power button 50, a unit selection button 52, increment/decrement buttons 54*a* and 54*b*, and three light emitting diodes (LEDs) 56*a*, 56*b* and 56*c*. Light emitting diodes 56*a*, 56*b* and 56*c* are green, yellow and red, respectively, when activated.

Figure 4:
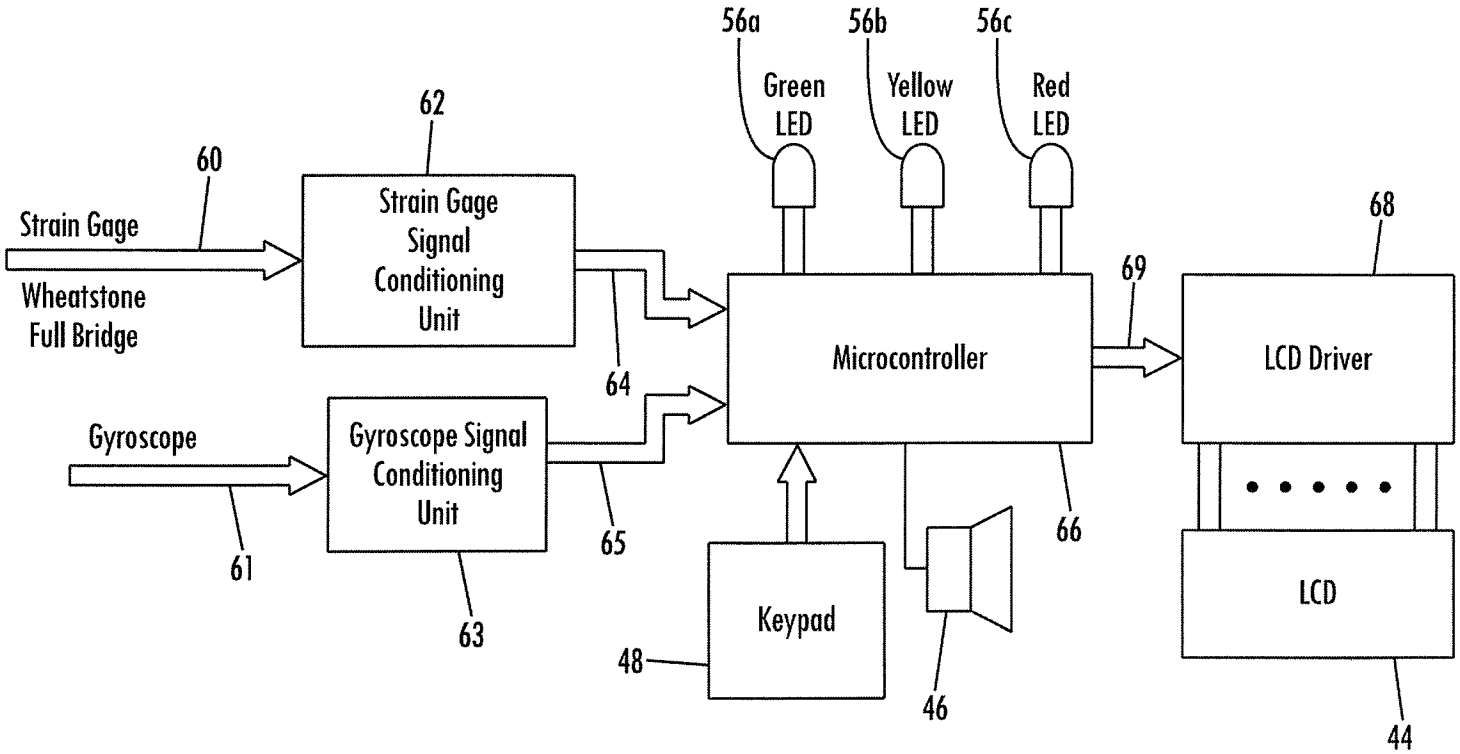
FIG. 4 is a block diagram representation of the electronics of the electronic torque wrench as shown is FIG. 2.

A block diagram representation of the electronics of the preferred embodiment, showing various inputs and outputs, is shown in FIG. 4. When electronic torque wrench 10 is used to apply and measure torque, the strain gages of the strain tensor sense the torque applied to the fastener and send an electrical signal 60 that varies in voltage proportionally to sensed torque to a strain gage signal conditioning unit 62 that amplifies the signal and filters it for noise. An amplified and conditioned analog electrical signal 64 is then fed to a processor, in this instance a microcontroller 66, that converts electrical signal 64 to an equivalent torque value in the desired units and adjusts for any offset of the signal, as discussed in greater detail below with respect to FIG. 5. Adjusting for the offset of the signal increases the accuracy of the wrench by compensating the signal for any reading that may be present before torque is actually applied to the fastener. Microcontroller 66 (which may comprise a monolithic device or a collection of discrete digital and/or analog devices) sends an electrical signal 69 that corresponds to the current torque value and the peak torque value to digital display 44, preferably a liquid crystal display (LCD) unit, via an LCD driver circuit 68. Preferably, digital display 44 displays the current torque value in the form of a bar graph display 70 (FIG. 9A) and simultaneously displays the peak torque value in the form of a numeric value display 72 (FIG. 9A) during the application of torque up to a preset torque value.

Figure 5:
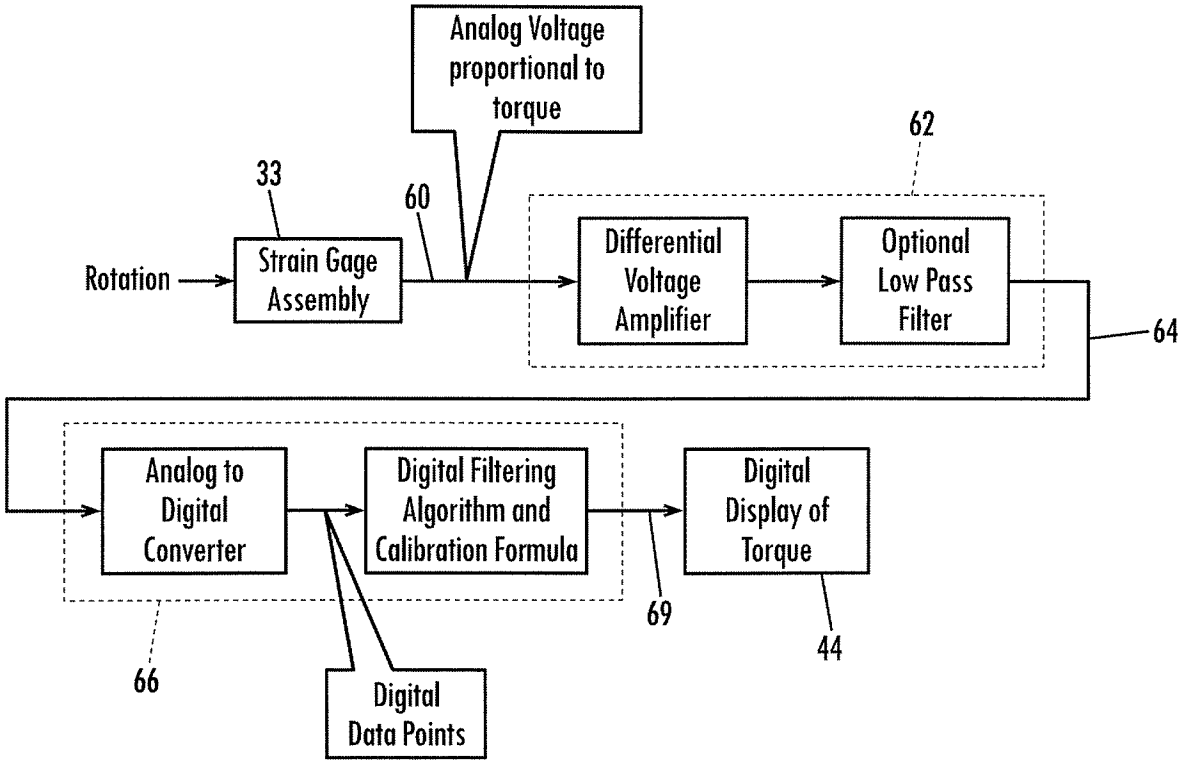
FIG. 5 is a block diagram representation of electronics of the electronic torque wrench as shown in FIG. 2.

Referring additionally to FIG. 5, microcontroller 66 converts analog electrical signal 64 to an equivalent torque value in the desired units. Upon receiving analog electrical signal 64, microcontroller 66 converts analog electrical signal 64 to digital data points using an analog-to-digital converter. As well, microcontroller 66 adjusts electrical signal 64 for any offset of the signal. When electronic torque wrench 10 is powered on, it is possible that strain gage assembly 33 will produce an electrical signal 60 even though no torque is being applied with electronic torque wrench 10. Various conditions, such as, temperature, unintended deformation of the strain tensor, etc., can cause a no-load electrical signal to be present when the torque wrench is powered on, which can thereby introduce an error into subsequent torque measurements. As such, microcontroller 66 determines the value of the no-load electrical signal 64 when the torque wrench is powered on and subtracts this value from all subsequent electrical signals 64 received from strain gage assembly 33 during torquing operations (until the next power-on event). Microcontroller 66 can adjust the received electrical signal 64 either prior to, or after, its conversion to a plurality of digital data points with the analog-to-digital converter. Since the conditions under which electronic torque wrench 10 are used can differ, microcontroller 66 determines the magnitude of the no-load electrical signal each time the electronic torque wrench is powered on and applies that value to that series of torquing operations that occur prior to powering off the electronic torque wrench.

In one embodiment, microcontroller 66 utilizes a moving window digital filtering algorithm to convert the digital data points into a plurality of equivalent digital values that it then uses to determine a current amount of torque being applied with the electronic torque wrench, as discussed in greater detail below with regard to FIG. 6. In the present example, microcontroller 66 samples one thousand digital data points per second and uses a moving sample window of ten milliseconds. As the electronic torque wrench applies torque, microcontroller 66 averages the first ten digital data points, one taken each millisecond, thereby producing a first equivalent digital value at time t=0.01 seconds, wherein t=0.0 seconds marks the initiation of the torquing operation. At time t=0.011 seconds, microcontroller 66 averages the digital data points taken between times t=0.002 and t=0.011 seconds, thereby producing a second equivalent digital value. At time t=0.012 seconds, microcontroller 66 averages the digital data points taken between times t=0.003 seconds and t=0.012 seconds, thereby producing a third equivalent digital value. This continues such that an equivalent digital value is provided every millisecond until the electronic torque wrench is no longer applying torque. In short, the digital filtering algorithm provides a rolling average in which the oldest digital data point is dropped each time a new digital data point is received within the sample window. Microcontroller 66 utilizes these equivalent digital values and a calibration formula, as discussed below with regard to FIG. 6, to determine the current equivalent torque value being applied by the electronic torque wrench.

Figure 6:
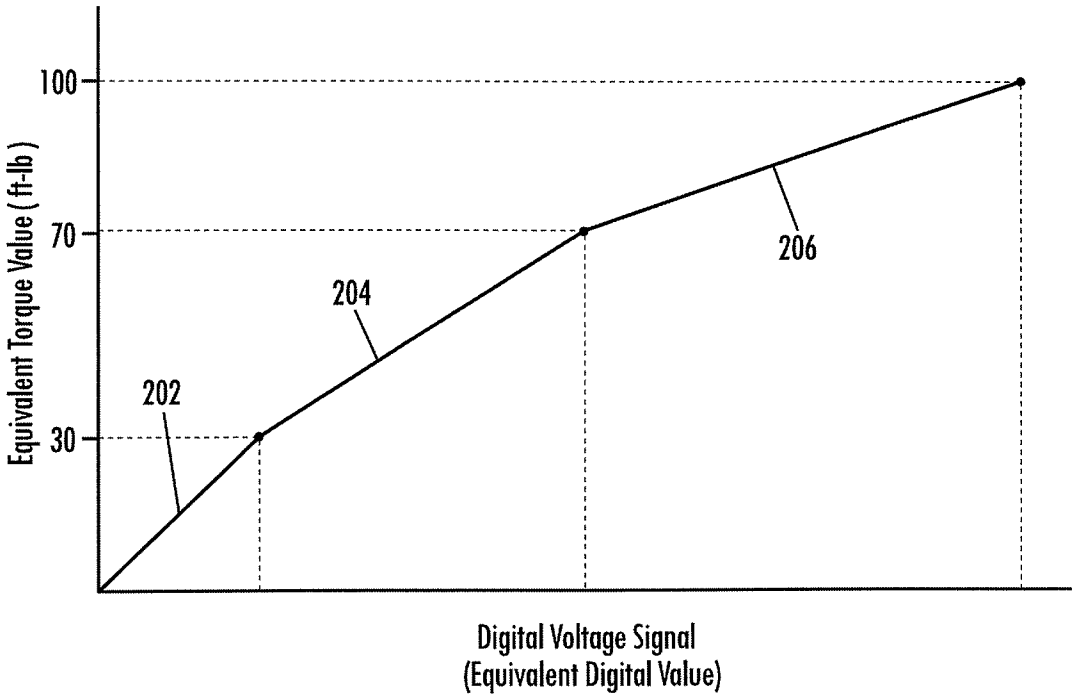
FIG. 6 is a graphical representation of the calibration formula of the electronic torque wrench as shown in FIG. 2.

FIG. 6 is a graphical representation of the calibration formula utilized by microcontroller 66 to convert the equivalent digital values from the stain gage assembly into equivalent torque values. Preferably, after assembly, each electronic torque wrench 10 is calibrated in order to derive its calibration formula. The electronic torque wrench is used to apply three known torque values at various points along the rated torque range of the torque wrench, those points being at 30%, 70% and 100% of the operating range maximum torque in the present embodiment. For example, for a torque wrench rated for torquing operations from 5.0 to 100.0 ft-lbs, 30.0, 70.0 and 100.0 ft-lbs of torque are applied with the electronic torque wrench and the equivalent digital value produced by the strain gage at each torque is measured. The three data points provide three different graph segments (202, 204 and 206) of which the slopes (m) and y-intercepts (b) can be found using the equation y=m(x)+b. The formulas for the graph segments 202, 204 and 206 are stored in memory and used by microcontroller 66 to determine equivalent torque values based on the received equivalent digital values. The use of multiple graph segments allows microcontroller 66 to compensate for non-linearity that may be present across the operating ranges of some strain gage assemblies. Alternate embodiments can have different numbers of graph segments, including as few as one.

For those instances where a lesser degree of accuracy is acceptable, the calibration formula of a single electronic torque wrench can be used in each torque wrench of the same design that utilizes the same model strain gage assembly. This negates the need to calibrate each individual torque wrench. Additionally, alternate embodiments may include as few as one graph segment when it is determined that it is not necessary to compensate for the potential non-linear operation of the strain gage assembly.

Typically, strain gage assemblies are configured such that a positive (+) voltage signal is produced when the assembly is under tension and a negative (−) voltage signal is produced when the assembly is under compression. As shown in FIG. 3, strain gage assembly 33 is mounted on flat portion 34 of wrench head 14 such that it undergoes compression when electronic torque wrench 10 is used to apply torque in the clockwise (CW) direction, thereby producing a negative voltage signal. Conversely, as would be expected, a positive voltage signal is produced by strain gage assembly 33 when electronic torque wrench 10 applies torque in the counterclockwise (CCW) direction since the strain gage assembly undergoes tension. Software included in the present embodiment of the torque wrench allows microcontroller 66 to utilize both positive and negative electrical signals in the determination of current applied torque values. Strain gage assembly 33 can also be mounted on a flat portion (not shown) of wrench head 14 that is opposite flat portion 34, in which case the voltage signals produced by strain gage assembly 33 are positive when torque is applied in the CW direction and negative when torque is applied in the CCW direction. Software similarly accounts for the type of signal received based on the placement of the strain gage assembly on the wrench head.

Referring again to FIG. 4, as the user applies torque to the wrench, and thereby the fastener, once the preset torque value has been applied to the fastener, the electronic torque wrench transitions from a first mode, or torque mode, to a second mode, or angle mode. As part of the shift in modes, microcontroller 66 sends an electrical signal to digital display 44, causing it to display the current accumulated angle value of the fastener as a numeric value, as shown in FIG. 9C. In the present embodiment, the user depresses the unit button 52 in order to change the operating mode from the torque mode to the angle mode and switch digital display 44 from displaying torque values to displaying angle values. In an alternate embodiment, microcontroller 66 determines when the electronic torque wrench 10 applies the preset torque value and produces an electrical signal that automatically shifts the electronic torque wrench 10 from the torque mode to the angle mode.

When electronic torque wrench 10 is used to measure angular rotation, gyroscopic sensor 35 senses the rotation of the electronic torque wrench and sends an electrical signal 61 that varies in voltage proportionally to the rate of rotation to a gyroscopic signal conditioning unit 63 that amplifies the signal and filters it to remove noise from the signal. Gyroscope signal conditioning unit 63 outputs an amplified and conditioned analog electrical signal 65 to microcontroller 66 that converts electrical signal 65 to an equivalent angular value in degrees and adjusts for any offset of the signal. Adjusting for the offset of the signal increases the accuracy of the wrench by compensating the signal for any reading that may be present before the wrench is actually rotated. Microcontroller 66 sends an electrical signal 69, including the current accumulated angle value to digital display 44, via LCD driver circuit 68. Preferably, digital display 44 displays the current accumulated angle value in the form of both a bar graph display 70 (FIG. 9C) and a numeric value display 72 (FIG. 9C) during the rotation of the wrench up to a preset target accumulated angle value, as shown in FIG. 9C.

Figure 7:
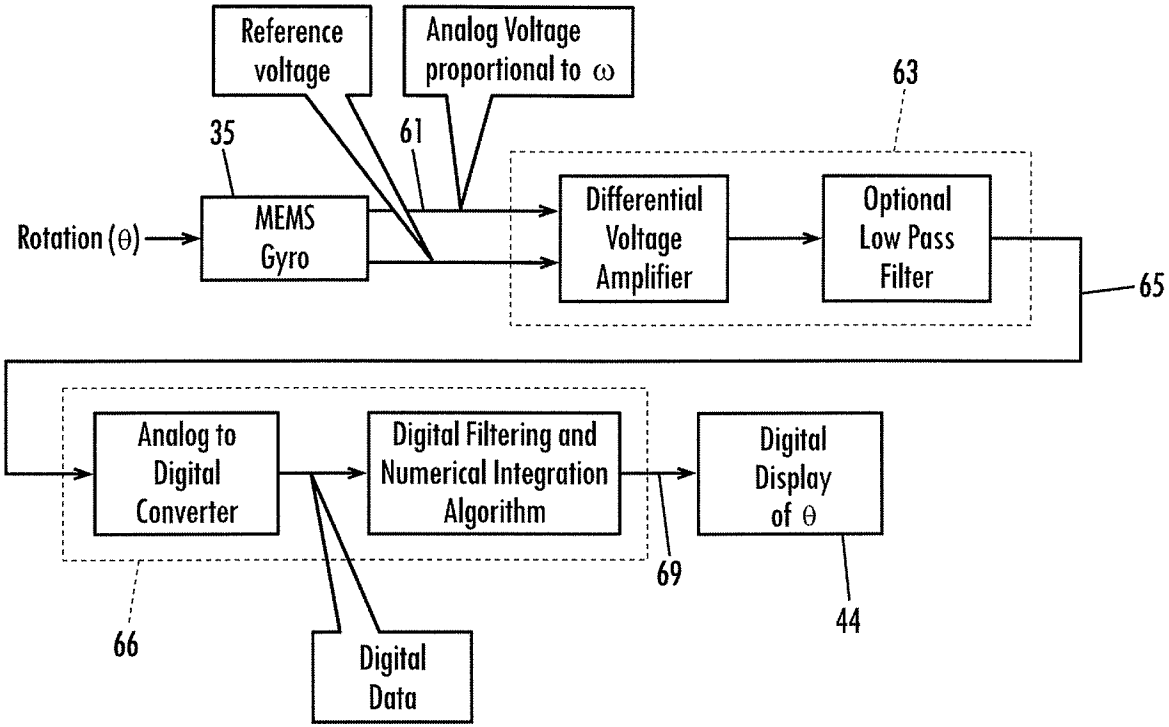
FIG. 7 is a block diagram representation of electronics of the electronic torque wrench as shown in FIG. 2.

Referring additionally to FIGS. 7 and 8, microcontroller 66 converts analog electrical signal 65 to an equivalent angle value in degrees. Upon receiving analog electrical signal 65, microcontroller 66 converts analog electrical signal 65 to digital data points using an analog-to-digital converter. As well, microcontroller 66 adjusts electrical signal 65 for any offset of the signal. When electronic torque wrench 10 is powered on, it is possible that gyroscopic sensor 35 will produce an electrical signal 61 even though electronic torque wrench 10 is not being rotated. As such, microcontroller 66 determines the value of the no-load electrical signal 65 when the torque wrench is powered on and subtracts this value from all subsequent electrical signals 65 received from gyroscopic sensor 35 during torquing operations. Microcontroller 66 can adjust the received electrical signal 65 either prior to, or after, its conversion to a plurality of digital data points with the analog-to-digital converter. Since the conditions under which electronic torque wrench 10 are used can differ, microcontroller 66 determines the magnitude of the no-load electrical signal 65 each time the electronic torque wrench 10 is powered on and applies that value to that series of torquing operations that occur prior to powering off the electronic torque wrench 10. Note, the offset signal applied by microcontroller 66 during torquing operations is dependent upon whether electronic torque wrench 10 is measuring the applied torque value or the accumulated angle value. More specifically, the value of the offset signal is derived from the no-load condition of strain gage assembly 33 when the electronic torque wrench is measuring applied torque values and is derived from the no-load condition of gyroscopic sensor 35 when the electronic torque wrench 10 is measuring accumulated angle values.

In one embodiment, microcontroller 66 utilizes a moving window digital filtering algorithm, similar to the one previously discussed, to convert the digital data points from the analog-to-digital converter into a plurality of equivalent digital values that it then uses to determine the accumulated angular rotation being applied with the electronic torque wrench 10, as discussed in greater detail below. In the present example, microcontroller 66 samples one thousand digital data points per second and uses a moving sample window of 10 milliseconds. As the electronic torque wrench rotates, microcontroller 66 averages the first ten digital data points, one taken each millisecond, thereby producing a first equivalent digital value at time t=0.01 seconds, wherein t=0.0 seconds marks the initiation of rotation of the torque wrench. At time t=0.011 seconds, microcontroller 66 averages the digital data points taken between times t=0.002 and t=0.011 seconds, thereby producing a second equivalent digital value. At time t=0.012 seconds, microcontroller 66 averages the digital data points taken between times t=0.003 seconds and t=0.012 seconds, thereby producing a third equivalent digital value. This continues such that an equivalent digital value is provided every millisecond until the electronic torque wrench 10 is no longer being rotated. Microcontroller 66 utilizes these equivalent digital values and a numerical integration method, as discussed below with regard to FIG. 8, to determine the accumulated angle value being applied by the electronic torque wrench 10.

Figure 8A:
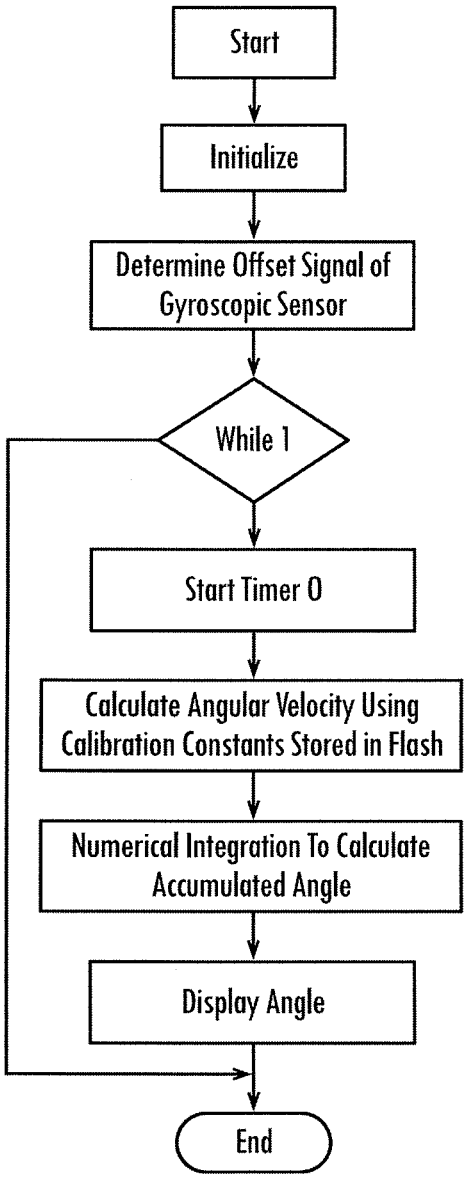
FIG. 8 is a flow chart of the algorithm utilized by the electronic torque wrench as shown in FIG. 2 to measure accumulated angular rotation of the wrench.
Figure 8B:
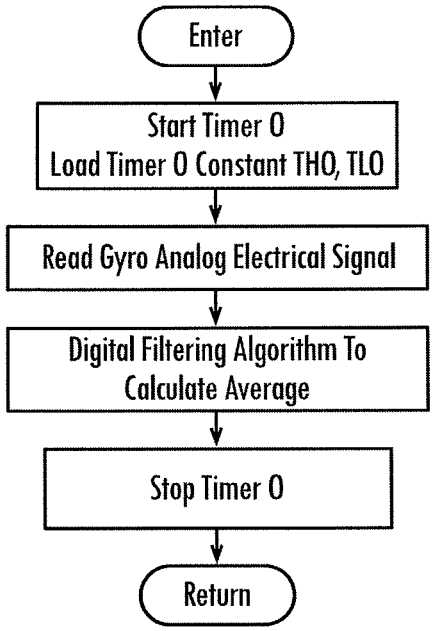

FIGS. 8A and 8B are flow charts of the algorithm utilized by electronic torque wrench 10 to determine accumulated angle values. More specifically, FIG. 8A is a flow chart of the main program of microcontroller 66, and FIG. 8B is a flow chart of an interrupt routine service program that the provides averaged values of the equivalent digital values discussed above with regard to the digital filtering algorithm. As shown, when the electronic torque wrench 10 is powered on, the electronics configuration is initialized, and microcontroller 66 determines the offset signal of gyroscopic sensor 35, as previously discussed. The operation of electronic torque wrench 10 while in torque mode has been previously discussed and is not repeated here for ease of description. Upon entering the angle mode, either manually or automatically, microcontroller 66 performs an infinite loop operation as long as the torque wrench is not powered off. Upon entering the loop, microcontroller 66 initiates a timing sequence that is related to the digital filtering algorithm discussed above. In the present embodiment, the timing sequence comprises a 10 millisecond window over which the equivalent digital values provided by the digital filtering algorithm are averaged such that an average equivalent digital value is provided for numerical integration every 10 milliseconds rather than every millisecond. For example, first average equivalent digital value of the first through tenth equivalent digital values is provided for numerical integration rather than the 10 individual values. As such, the next value provided is a second average equivalent digital value of the eleventh through twentieth equivalent digital values. At the end of each 10 millisecond window, the timing sequence interrupts the main program and provides the average equivalent digital value, which microcontroller 66 then uses to calculate the angular velocity of electronic torque wrench 10 over that 10 millisecond window by retrieving a corresponding calibration constant that is stored in flash memory. Each calibration constant corresponds to an angular velocity value that is previously determined during the calibration of the torque wrench, as discussed below. Microcontroller 66 performs a numerical integration with the average angular velocity values determined for each 10 millisecond period to determine the accumulated angle value through which the electronic torque wrench is rotated, and subsequently, the fastener as well. Microcontroller 66 sends an electrical signal including the current accumulated angle value to the digital display. In the present embodiment of the torque wrench, microcontroller 66 performs the numerical integration in accordance with the equation:

$$\theta = \sum_{i=0}^{n} \omega_i \Delta t$$

where, (θ) is the accumulated angle value, (ω) is the calibration constant retrieved by the microcontroller 66 in response to receiving the ($i^{th}$) average equivalent digital value, and Δt is the preferred sample period of 10 milliseconds.

Note, in alternate embodiments of the electronic torque wrench, the digital filtering algorithm does not utilize the moving window method of averaging to determine the individual equivalent digital values. Rather, the digital filtering algorithm determines an independent equivalent digital value each millisecond that corresponds to the electrical signal produced by gyroscopic sensor 35, beginning at time t=0.001. The digital filtering algorithm then averages the individual equivalent digital values over a selected window of time, that being 10 milliseconds in the present example, and provides the average equivalent digital value to microcontroller 66 for use in the previously discussed numerical integration method. In yet another alternate embodiment of the electronic torque wrench, no averaging feature is utilized by the digital filtering algorithm in providing equivalent digital values. Rather, the digital filtering algorithm simply produces an equivalent digital value at the end of a selected window of time, that being 10 milliseconds in the present example, and provides this equivalent digital value to microcontroller 66 for use in the previously discussed numerical integration method. These embodiments may be desirable when a lesser degree of accuracy from the electronic torque wrench is acceptable.

Preferably, after assembly, each electronic torque wrench 10 is calibrated in order to derive the previously discussed calibration constants that are stored in flash memory. The electronic torque wrench is rotated at a plurality of known angular velocities that would be expected to be encountered during normal operation of the electronic torque wrench. The equivalent digital value produced at each known angular velocity is measured and recorded. A curve is fit to these data points that allows the determination of the angular rotational value, or calibration constant, for each received equivalent digital value.

Microcontroller 66 generates alarm signals in the form of audio signals and light displays of appropriate color once either it is determined that the current torque value is within a pre-selected range of the preset torque value or that the current accumulated angle value of the fastener is within a pre-selected range of the preset target accumulated angle value, depending on the wrench's operating mode and as discussed in greater detail hereafter. A red LED coincides with the alarm signals to indicate to the user that the preset torque value has been reached. At this point, digital display 44 is switched, either manually by the user or automatically by the microcontroller 66, from the torque mode to the angle mode such that it displays accumulated angle values rather than torque values, as previously described.

Figure 9A:
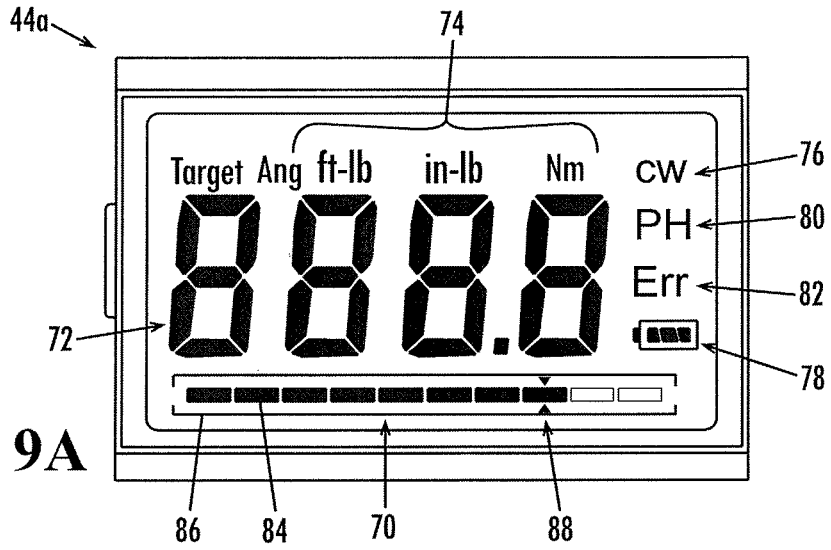
FIGS. 9A, 9B and 9C are views of a display device as used with the electronic torque wrench shown in FIG. 2.
Figure 9B:
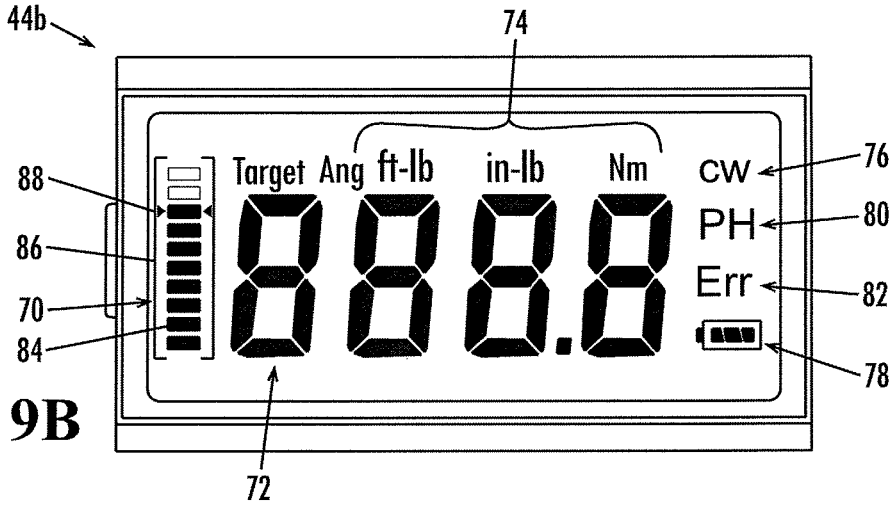
Figure 9C:
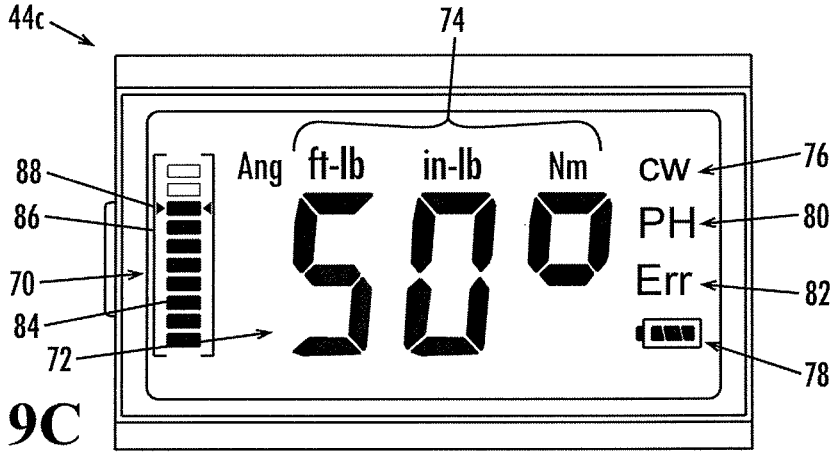
Figure 10A:
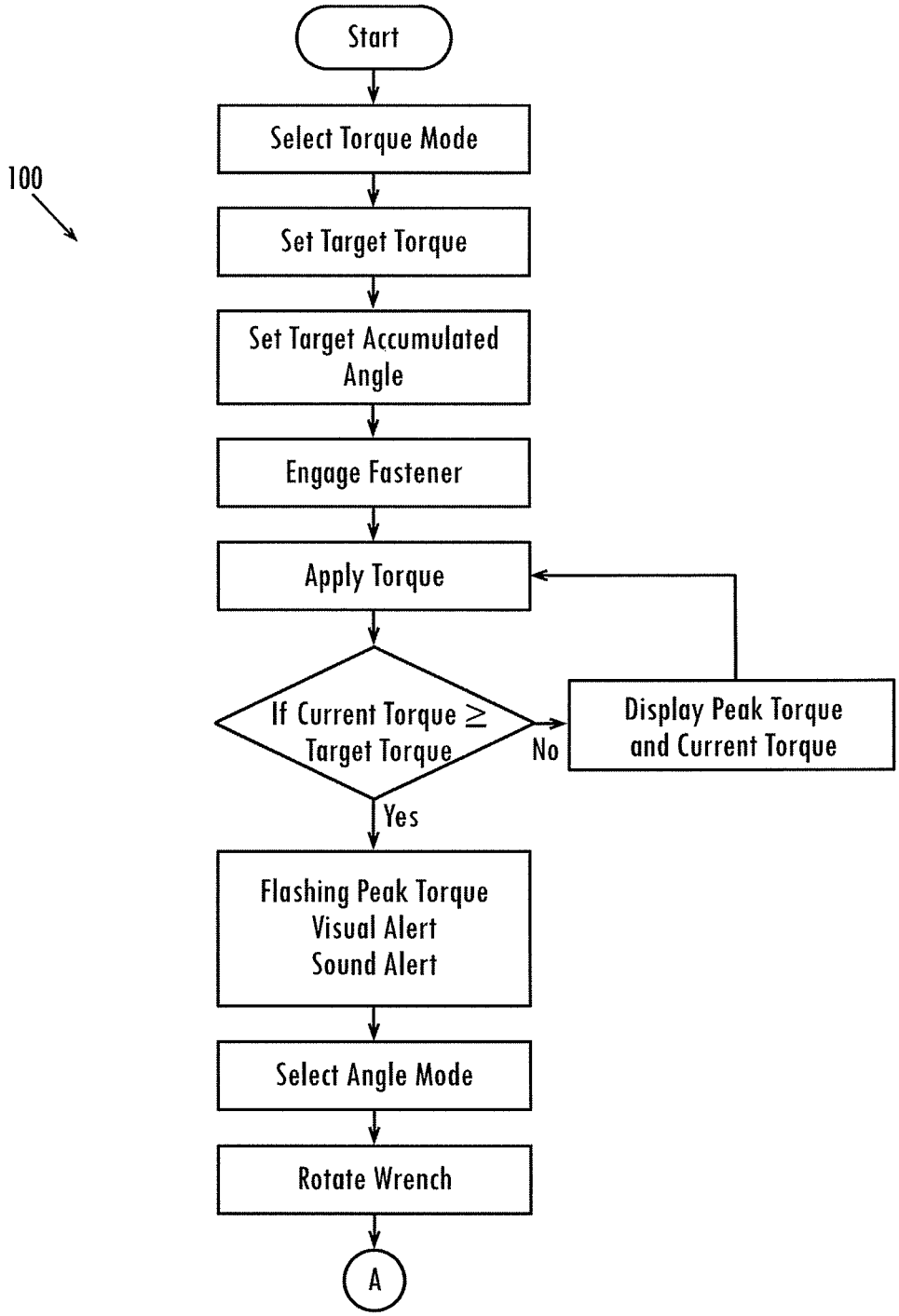
FIG. 10 is a flow chart of the display algorithm of the display device as shown in FIGS. 9A, 9B and 9C.
Figure 10B:
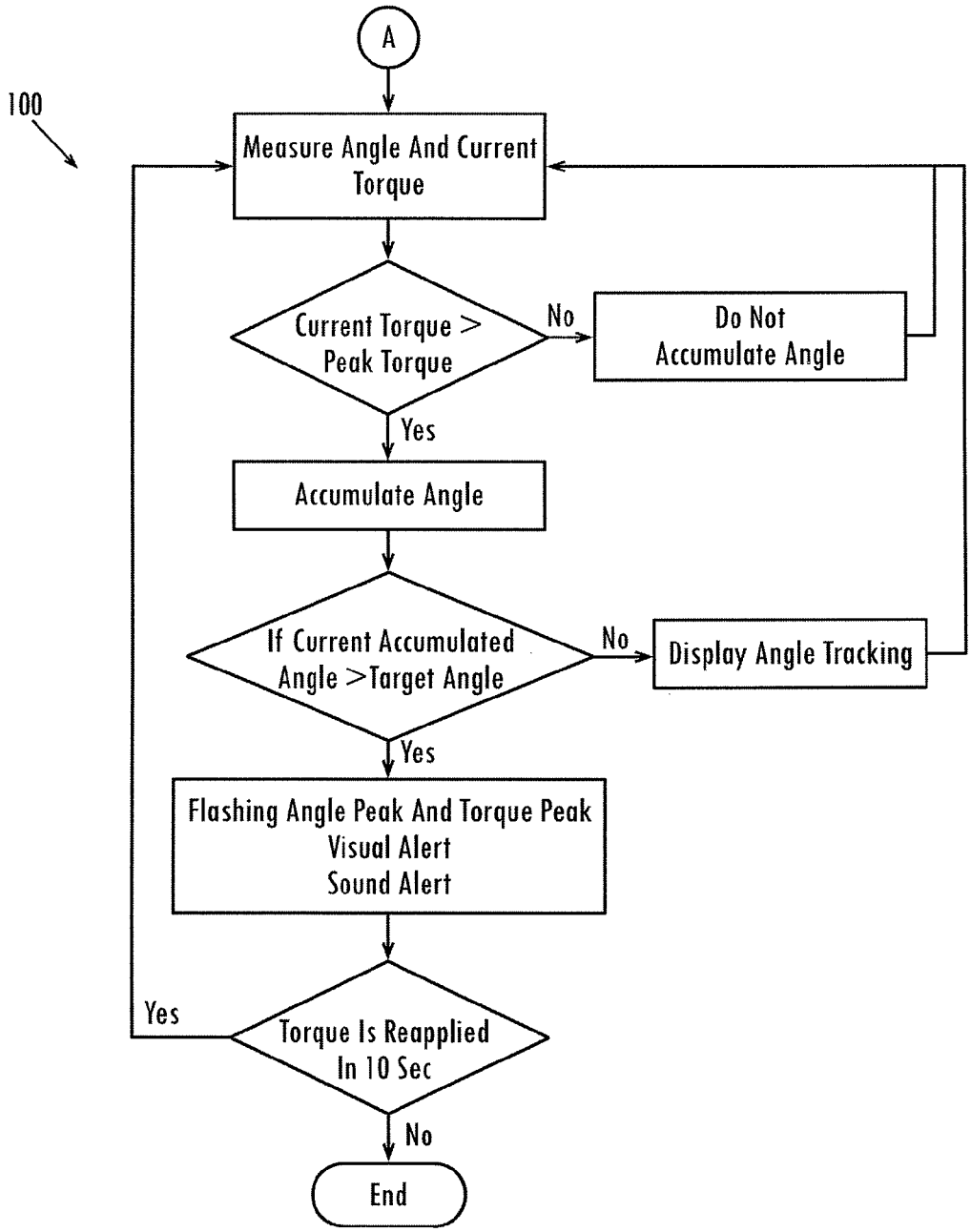

FIGS. 9A and 9B show detailed views of preferred embodiments of digital displays 44*a* and 44*b*, respectively. The LCD units include a current torque level/accumulated angle indicator 70, a four digit numeric display 72, an indication of units selected 74 (foot-pound, inch-pound, Newton-meter and degrees), a torque direction indicator 76 (clockwise (CW) by default and counter-clockwise (CCW) if selected), a battery level indicator 78, a peak hold (PH) indicator 80 and an error (Err) indicator 82. As shown, current torque level/accumulated angle indicator 70 is in the form of a bar graph. The bar graph is shown in two embodiments, horizontal 44*a* (FIG. 9A) and vertical 44*b* (FIG. 9B). In either case, preferably, the bar graph includes a total of ten segments 84 and a frame 86 that encompasses all ten segments 84. Frame 86 is filled by the ten segments when either the preset torque value or preset accumulated angle value input by the user, as discussed below with regard to FIGS. 10A and 10B, is reached. At other times, frame 86 is only partially filled with segments 84, and therefore gives a graphical display of approximately how much torque is currently being applied and how much more torque needs to be applied to the fastener to reach the preset torque value, or how much accumulated angular rotation the fastener has undergone and how much more needs to occur.

As shown, two small arrows 88 are located on opposing sides of the eighth segment. Arrows 88 are graphical indicators to the user that the current torque level or accumulated angle measurement is above 75% of the preset value. Each segment 84 within frame 86 represents 10% of the preset torque/angle value, starting from the left or bottom of each bar graph, respectively. For example, if only the first two of segments 84 are displayed, the current torque/angle value is above 15% and below 24% of the preset torque/angle value, and is therefore approximately 20% of the preset torque/angle value. Simultaneously, digital display 44*a*/44*b* also displays the peak torque value or accumulated angle value, respectively, applied up until that time in numeric display 22.

Preferably, during the initial application of torque to the fastener, the user, rather than focusing on four digit numeric display 72, views the bar graph of current torque level indicator 70 until the applied torque level reaches approximately 75% to 80% of the preset target torque value, depending on the user's comfort level when approaching the preset torque level. At this point, the user may change focus to numeric display 72 for a precise indication of the current torque being applied as the preset torque value is approached. As discussed, numeric display 72 shows the peak torque value to which the fastener has been subjected. As such, if the user has "backed off" during the application of torque such as during ratcheting operations, the value indicated on numeric display 72 will not change until it is exceeded by the current torque value. Display device 44*a*/44*b* allows the user to apply torque to the fastener and know both how much torque is currently applied and how much more torque needs to be applied before reaching the target preset torque value.

Similarly, once the target preset torque value has been reached and the angular rotation mode is entered, the user may, rather than focusing on four digit numeric display 72, view the bar graph of current accumulated angle indicator 70 until the applied accumulated angle value reaches approximately 75% to 80% of the preset target accumulated angle value, depending on the user's comfort level when approaching the preset value. At this point, the user may change focus to numeric display 72 for a precise indication of the current accumulated angle through which the fastener has been rotated as the preset target value is approached. Numeric display 72 shows the accumulated angle value to which the fastener has been subjected. As such, if the user has "backed off" during the application of rotation, such as during ratcheting operations, the value indicated on numeric display 72 will not change until the electronic torque wrench senses further rotation of the fastener. Display device 44*c* allows the user to know both how much rotation the fastener has undergone and how much more rotation needs to occur before reaching the target preset accumulated angle value.

FIGS. 10A and 10B illustrate a flow chart 100 of the algorithm used with the electronics unit. Prior to initiating torquing operations, the input device is used to set a preset target torque value into the electronic torque wrench that equals the maximum desired torque to be applied to the fastener during the torquing mode. Preferably, the torque mode is the default mode of the electronic torque wrench when it is powered on. As well, after inputting the preset target torque value, the user selects the target angle mode and inputs a preset target accumulated angle value into the electronic torque wrench that equals the maximum desired angular rotation to be applied to the fastener subsequent to reaching the preset target torque value. After the preset target accumulated angle value is entered, the electronic torque wrench reverts to the torque mode, and numeric display 72 displays the preset target torque value in numeric display 72 (FIGS. 9A and 9B) until the user actually applies torque to the fastener, at which time microcontroller 66 switches the numeric display to display the peak torque value.

Figure 11:
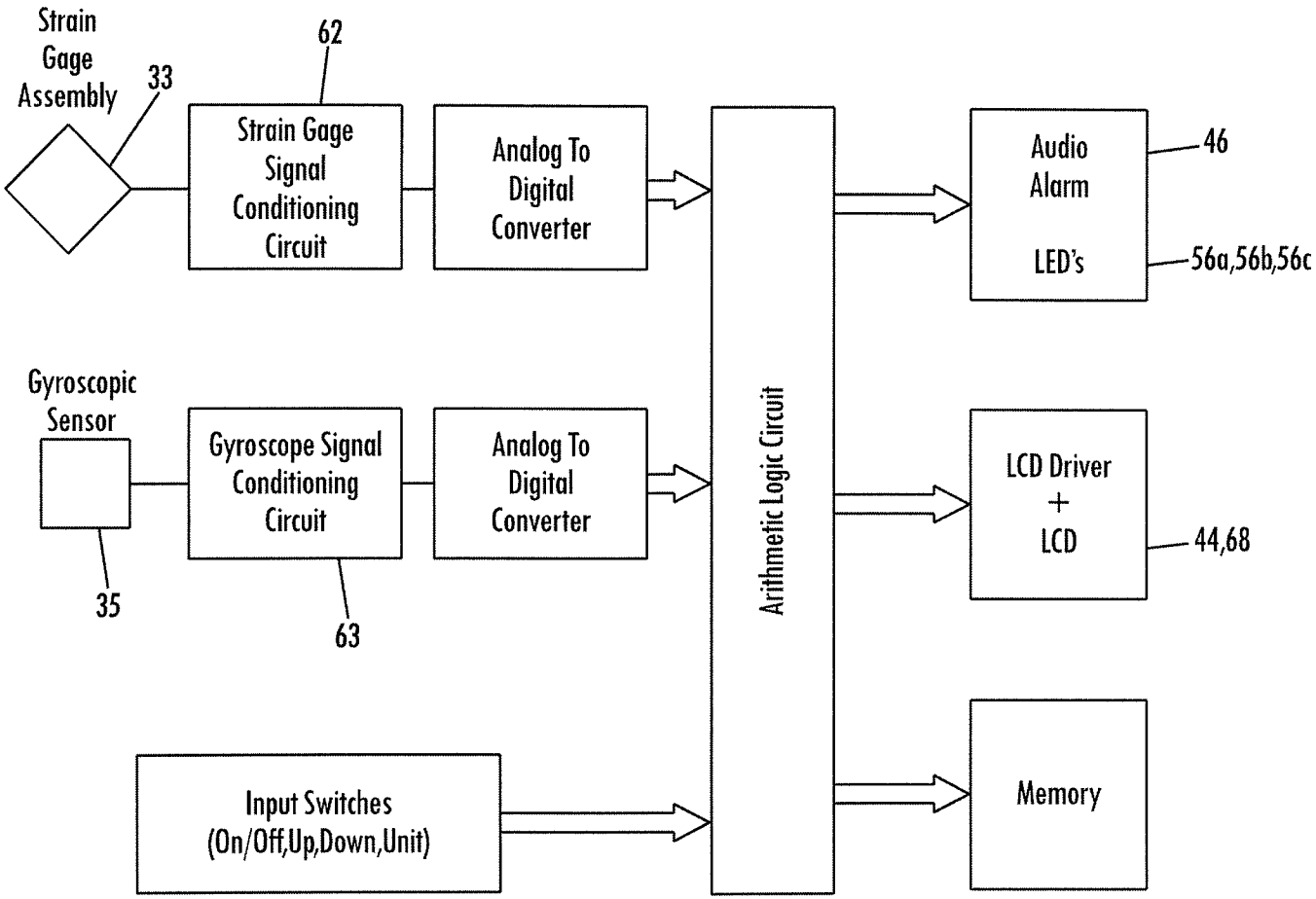
FIG. 11 is a block diagram of the circuit of the electronic torque wrench as shown in FIG. 2.

Referring additionally to FIGS. 4 and 11, as torque is applied, microcontroller 66 (for example, Model No. ADuC843 manufactured by Analog Devices, Inc.) receives and reads a signal conditioned analog electrical signal 64 (as previously discussed with regard to FIG. 4) from strain gage signal conditioning circuit 62, converts the analog electrical signal to an equivalent digital number, converts the digital number to an equivalent current torque value corresponding to the user selected units (as previously discussed with regard to FIG. 5), and determines whether the current torque value is a new peak torque value. This is accomplished by comparing the current torque value to the existing peak torque value, and either replacing the peak torque value if it is exceeded, or letting it remain if it is not. Once both the current torque value and peak torque value are determined, microcontroller 66 sends electrical signal commands 69 to LCD driver circuit 68 (Model No. HT1621 manufactured by Holtek Semiconductors, Inc., Taipei, Taiwan) to generate appropriate signals to digital display unit 44 for updating the number of segments 84 shown in current torque level indicator 70 and the peak torque value shown in numeric display 72.

In addition, microcontroller 66 switches green 56*a*, yellow 56*b*, and red 56*c* LEDs on or off depending on the peak torque value applied to the fastener up until that time. Preferably, microcontroller 66 maintains green LED 56*a* on as long as the peak torque value is below 85% of the preset torque value and switches it off once the peak torque reaches 85% of the preset torque value. Microcontroller 66 switches yellow LED 56*b* on for peak torque values greater than 85% but less than 96% of the preset torque value. Microcontroller 66 switches red LED 56*c* on once the peak torque value reaches 96% of the preset torque value and stays on thereafter. Once the current torque value reaches the preset torque value, or is within a user selected range, microcontroller 66 generates electrical signals to generate an alarm sound on annunciator 46. At this point, the user ceases to rotate the electronic torque wrench and numeric display 72 flashes the peak torque value that was applied to the fastener during the torquing mode. The selection of percentage ranges for each color may be programmed, and the percentages at which the LEDs are switched on or off can be changed to suit the specific application. Alternate embodiments may include liquid crystal display devices that are capable of displaying multiple colors. This permits the warning LEDs to be replaced by colored symbols on the LCD. As well, the segments of the bar graphs and graphical displays can be made to have varying colors.

Once the preset torque value is reached, the user enters the angle mode by pressing unit button 52. In alternate embodiments, the electronic torque wrench automatically enters the angle mode once the preset target torque value is reached. As the user begins to rotate the electronic torque wrench, microcontroller 66 receives and reads a signal conditioned analog electrical signal 61 (as previously discussed with regard to FIG. 4) from gyroscopic sensor 35, converts the analog electrical signal to an equivalent digital number, and converts the digital number to an equivalent current angle value. Simultaneously, microcontroller 66 measures the current torque value and determines whether the current torque value has exceeded the previously reached peak torque value achieved during the torque mode, as discussed above. If the current torque value has not exceeded the previously reached peak torque value, microcontroller 66 does not measure and accumulate the angular rotation of the electronic torque wrench that may have occurred since the fastener will not rotate until the torque being applied has exceeded the previously applied peak torque value. Once the current torque value exceeds the peak torque value, microcontroller 66 begins to measure and accumulate the angular rotation of the electronic torque wrench, and therefore the angular rotation of the fastener. Microcontroller 66 also determines whether the current accumulated angle value is equal to or greater than the preset target accumulated angle value. If the current accumulated angle value has not yet reached the target value, microcontroller 66 sends electrical signal commands 69 to LCD driver circuit 68 to generate appropriate signals to digital display unit for updating the number of segments 84 shown in current accumulated angle indicator 70 and the current accumulated angle value shown in numeric display 72.

Similarly to operations during the torquing mode, microcontroller 66 switches green 56*a*, yellow 56*b*, and red 56*c* LEDs on or off depending on the current accumulated angle value applied to the fastener up until that time. Preferably, microcontroller 66 maintains green LED 56*a* on as long as the current accumulated angle value is below 85% of the preset target accumulated angle value and switches it off once the current accumulated angle reaches 85% of the preset target accumulated angle value. Microcontroller 66 switches yellow LED 56*b* on for current accumulated angle values greater than 85% but less than 96% of the preset target accumulated angle value. Microcontroller 66 switches red LED 56*c* on once the current accumulated angle value reaches 96% of the preset target accumulated angle value and stays on thereafter. Once the current torque value reaches the preset target accumulated angle value, or is within a user selected range, microcontroller 66 generates electrical signals to generate an alarm sound on annunciator 46. At this point, the user ceases to rotate the electronic torque wrench, and numeric display 72 alternately flashes both the peak torque value and the final accumulated angle value to which the fastener was subjected. Note, it may be possible to achieve the preset target accumulated angle value without having to use the ratcheting feature of the electronic torque wrench. However, in many applications, the fastener will need to be rotated by using multiple ratcheting cycles, which is discussed in greater detail below. The selection of percentage ranges for each color may be programmed, and the percentages at which the LEDs are switched on or off can be changed to suit the specific application.

The torque wrench continues to accumulate angle either until the wrench is powered off or until the user releases the angle mode button (thereby ending the while loop indicated in FIG. 8A). Thus, the wrench may be considered to accumulate angle during a period that is predetermined by those conditions.

Figure 12A:
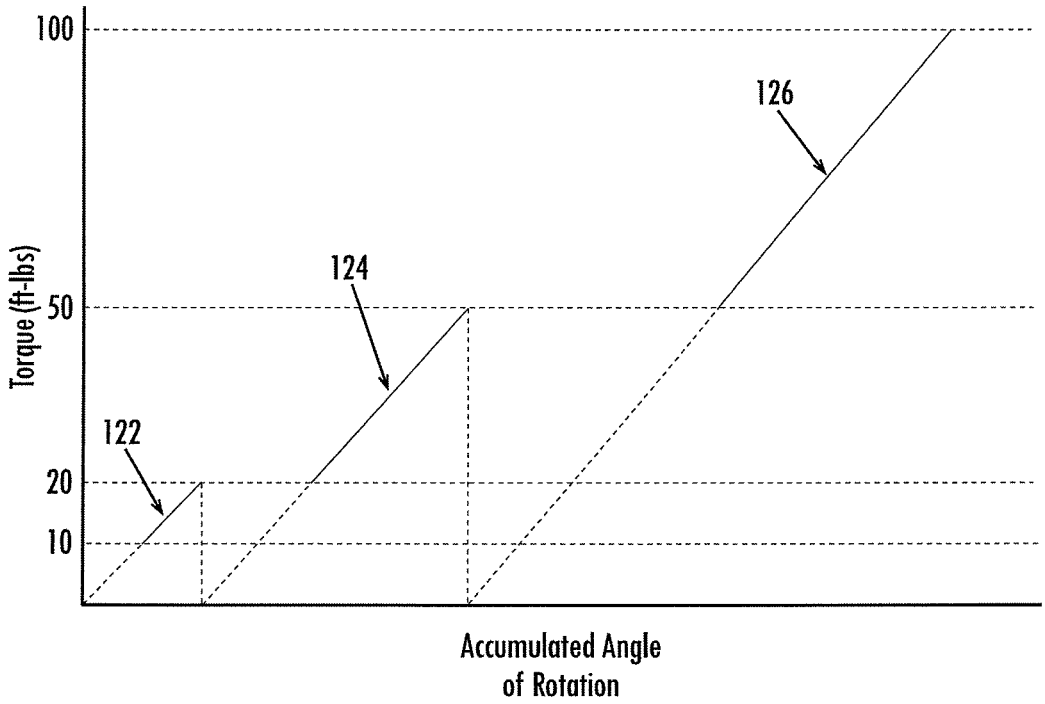
FIGS. 12A and 12B are graphical representations of the accumulation of angular rotation of a fastener using a ratcheting electronic torque wrench as shown in FIG. 2.

A graphical representation of a torquing operation using an electronic torque wrench in accordance with the present invention is shown in FIG. 12A. As previously discussed, to help prevent the inaccuracies found in prior art ratcheting electronic torque wrenches, the electronic torque wrench in accordance with the present invention only measures and accumulates angular rotation of the electronic torque wrench, and therefore fastener, once the current torque value being applied to the fastener exceeds the peak torque value achieved during the previous torquing cycle. Consider, for example, an electronic torque wrench in accordance with the present invention that is rated for 100 ft-lbs and is used to rotate a fastener through a 90° angle, wherein the position of the fastener means the electronic torque wrench can only be rotated through 30° during each cycle. As shown in FIG. 12A, as the first 30° of rotation subsequent to reaching the preset target torque value, that being 10 ft-lbs in the present example, are applied to the fastener, the amount of angular rotation of the electronic torque wrench is measured from the previously-applied 10 ft-lbs of torque up to the maximum torque applied to the fastener during the first cycle, for example 20 ft-lbs. The angular rotation of the fastener during the first cycle is represented by the solid line portion of the graph, indicated by 122. Note, the 10 ft-lbs threshold for measuring and accumulating angular rotation during the first cycle is based upon an initial preset target torque value of 10 ft-lbs having already been applied to the fastener during the torquing mode.

For the second cycle, the electronic torque wrench rotates through an additional 30° and a new maximum torque value of 50 ft-lbs is reached. Unlike the first cycle, the measurement and accumulation of angular rotation begins only after 20 ft-lbs of torque is applied to the fastener by the electronic torque wrench. The new threshold level for measuring and accumulating angular rotation is based upon the maximum torque applied during the previous cycle since the fastener will not rotate during the second cycle until the maximum applied torque of the first cycle is exceeded. As such, angular rotation of the fastener is only measured and accumulated between 20 ft-lbs and 50 ft-lbs, as represented by portion 124 of the graph. Similarly, for the third cycle, the new threshold value for measuring and accumulating angular rotation of the fastener is the previous cycle's maximum applied torque of 50 ft-lbs. Therefore, angular rotation of the fastener is only measured and accumulated during the third cycle between 50 ft-lbs and 100 ft-lbs, as represented by portion 126 of the graph. In this manner, inaccuracies due to play in the ratcheting mechanism, deflection of the electronic torque wrench body, etc., during multiple ratcheting cycles are minimized in that angular rotation is only measured and accumulated during those times in which the fastener is actually rotating.

Figure 12B:
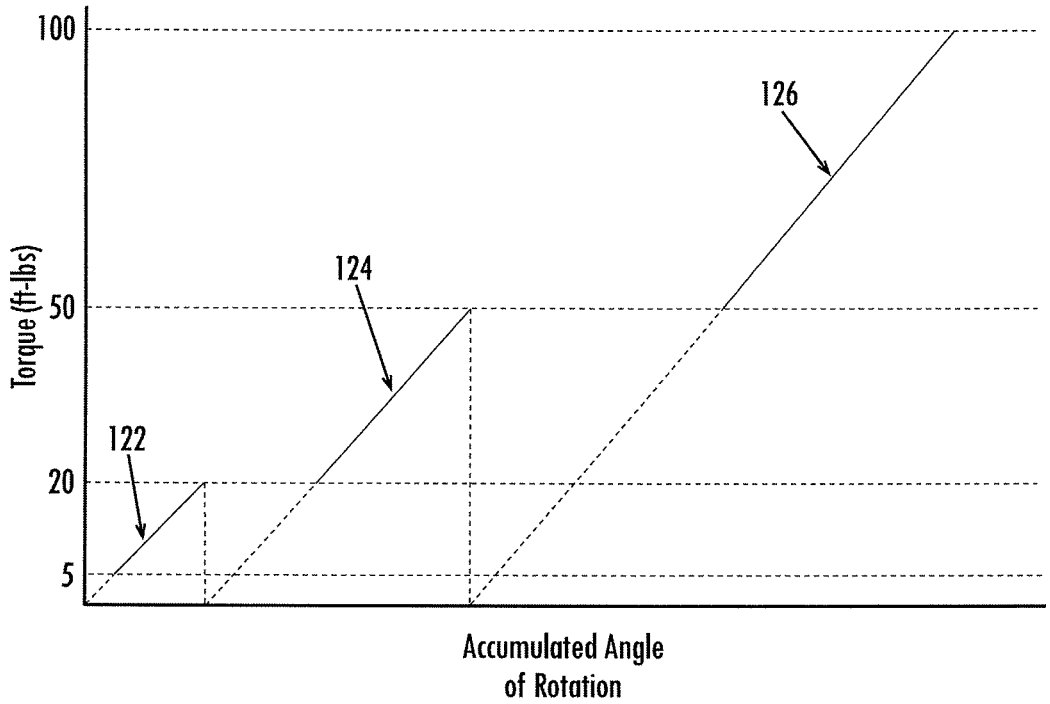

A graphical representation of a torquing operation using an alternate embodiment of electronic torque wrench in accordance with the present invention is shown in FIG. 12B. The present embodiment operates similarly to the embodiment previously discussed with regard to FIG. 12A, with the exception that it also includes a fixed threshold for the initiation of angular measurement and accumulation. Similarly to the previously discussed electronic torque wrench, the electronic torque wrench in accordance with the present embodiment only measures and accumulates angular rotation of the electronic torque wrench, and therefore fastener, once the current torque value being applied to the fastener exceeds the peak torque value achieved during the previous torquing cycle. However, for the instances in which there is no initial torquing cycle during which a preset target torque value is applied to the fastener, such as when the fastener only requires tightening by hand prior to the application of angular rotation, the present electronic torque wrench only begins measuring and accumulating angular rotation after a fixed percentage of the torque wrench's rated capacity is reached, such as 5%. Consider, for example, an electronic torque wrench in accordance with the present embodiment that is rated for 100 ft-lbs and is used to rotate a fastener through a 90° angle, wherein the position of the fastener means the electronic torque wrench can only be rotated through 30° during each cycle and the accumulation of the fastener's angular rotation begins only after the electronic torque wrench applies 5 ft-lbs of torque (i.e. 5% of its rated capacity). As shown in FIG. 12B, as the first 30° of rotation subsequent to hand tightening the fastener are applied to the fastener, the amount of angular rotation of the electronic torque wrench is measured from the threshold torque value of 5 ft-lbs of torque up to the maximum torque applied to the fastener during the first cycle, for example 20 ft-lbs. The angular rotation of the fastener during the first cycle is represented by the solid line portion of the graph, indicated by 122. The present electronic torque wrench functions similarly to the embodiment discussed previously with regard to FIG. 12A during subsequent rotational cycles, so further discussion of those cycles is not repeated here.

While one or more preferred embodiments of the invention are described above, it should be appreciated by those skilled in the art that various modifications and variations can be made in the present invention without departing from the scope and spirit thereof. It is intended that the present invention cover such modifications and variations as come within the scope and spirit of the appended claims and their equivalents.

What is claimed is:

1. An electronic torque wrench for engaging a workpiece, comprising;

a wrench body;

a wrench head disposed on the wrench body, the wrench head being configured to engage the workpiece;

a ratchet assembly disposed between the wrench body and the wrench head so that torque can be applied to the workpiece using multiple rotational cycles of the electronic torque wrench without having to disengage the workpiece;

a first sensor operatively coupled to the wrench head and producing a first output signal, the first output signal being proportional to an amount of torque being applied to the workpiece by the torque wrench;

a second sensor operatively coupled to the wrench body and producing a second output signal, the second output signal being proportional to an amount of rotation being applied to the workpiece by the torque wrench;

a user interface carried by the wrench body, the user interface including a digital display with a first readout and an input device for inputting a preset torque value; and a processor that receives the first output signal and the second output signal and is programmed to convert the first output signal into a value of a current torque being applied to the workpiece, compare the value of the current torque to both the preset torque value and a value of a peak applied torque to which the workpiece has been subjected, and convert the second output signal into a first angle value through which the workpiece has been rotated after the value of the current torque exceeds both the preset torque value and the value of the previous peak applied torque.

2. The electronic torque wrench of claim 1, wherein the processor is further programmed to determine a value of a peak applied torque during a first rotational cycle, convert the first output signal into a value of a current torque being applied to the workpiece during a second rotational cycle, compare the value of current torque of the second rotational cycle to the value of the peak applied torque of the first rotational cycle, and convert the second output signal of the second rotational cycle into a second angle value through which the workpiece has been rotated after the value of the current torque of the second rotational cycle exceed the value of the peak applied torque of the first rotational cycle.

3. The electronic torque wrench of claim 2, wherein the processor is further programmed to add the first angle value and the second angle value to determine an accumulated angle value.

4. The electronic torque wrench of claim 1, the first sensor further comprising a strain gage assembly for indicating the amount of torque applied to the workpiece.

5. The electronic torque wrench of claim 1, the second sensor further comprising a gyroscopic sensor for indicating the amount of angular rotation applied to the workpiece.

6. The electronic torque wrench of claim 1, wherein the user interface further comprises a second readout, wherein the first readout displays a value of the peak applied torque continuously during torque mode operations and the second readout displays a value of an applied torque continuously during torque mode operations.

7. The electronic torque wrench of claim 6, wherein the first readout is a numeric display and the second readout is a bar graph display for indicating the proximity of the value of the applied torque to the preset torque value during torque mode operations.

8. The electronic torque wrench of claim 1, wherein the processor is programmed to compare the value of a current torque of a rotational cycle to a threshold torque value, and convert the second output signal into a first angle value through which the workpiece has been rotated after the value of the current torque exceeds the threshold torque value.

9. The electronic torque wrench of claim 8, wherein the rotational cycle further comprises a first rotational cycle of the electronic torque wrench.

10. An electronic torque wrench for engaging a workpiece, comprising;

a wrench body;

a wrench head disposed on the wrench body, the wrench head being configured to engage the workpiece;

a ratcheting assembly disposed between the wrench body and the wrench head so that torque can be applied to the workpiece using multiple rotational cycles of the torque wrench;

a strain gage assembly operatively coupled to the wrench head and producing a first output signal, the first output signal being proportional to an amount of torque being applied to the workpiece by the torque wrench;

a gyroscopic sensor operatively coupled to the wrench body and producing a second output signal, the second output signal being proportional to an amount of rotation being applied to the workpiece by the torque wrench;

a user interface carried by the wrench body, the user interface including an input device for inputting a preset torque value; and a processor that receives the first output signal and the second output signal and is programmed to convert the first output signal into a value of a current torque being applied to the workpiece, compare the value of the current torque to both the preset torque value and a value of a peak applied torque to which the workpiece has been subjected, and convert the second output signal into a first angle value through which the workpiece has been rotated after the value of the current torque exceeds both the preset torque value and the value of the previous peak torque.

11. The electronic torque wrench of claim 10, wherein the processor is further programmed to determine a value of a peak applied torque during a first rotational cycle, convert the first output signal into a value of a current torque being applied to the workpiece during a second rotational cycle, compare the value of the current torque of the second rotational cycle to the value of the peak torque of the first rotational cycle, and convert the second output signal of the second rotational cycle into a second angle value through which the workpiece has been rotated after the value of the current torque of the second rotational cycle exceeds the value of the peak applied torque of the first rotational cycle.

12. The electronic torque wrench of claim 11, wherein the processor is further programmed to add the first angle value and the second angle value to determine an accumulated angle value.

13. The electronic torque wrench of claim 10, wherein the user interface further comprises a first readout and a second readout, wherein the first readout displays a value of a peak torque continuously during torque mode operations and the second readout displays a value of an applied torque continuously during torque mode operations.

14. The electronic torque wrench of claim 13, wherein the first readout is a numeric display and the second readout is a bar graph display for indicating the proximity of the applied torque value to the preset torque value during torque mode operations.

15. The electronic torque wrench of claim 13, wherein the first readout displays an accumulated angle value continuously during angle mode operations and the second readout indicates the proximity of the accumulated angle value to a preset accumulated angle value during angle mode operations.

16. An electronic torque wrench for engaging a workpiece, comprising:

a wrench body;

a wrench head in driving engagement with the wrench body, the wrench head being configured to engage the workpiece;

a ratchet coupling disposed in the wrench head and configured to receive the workpiece so that the ratchet coupling transfers torque from the wrench head to the workpiece in one rotational direction of the wrench head but permits relative rotation between the wrench head and the workpiece in an opposite rotational direction of the wrench head;

a first sensor operatively coupled with the wrench head and outputting a first signal, the first signal corresponding to a torque being applied to the workpiece by the torque wrench;

a second sensor operatively coupled to the wrench body and outputting a second signal, the second signal corresponding to rotation of the torque wrench about an axis of the workpiece when the torque wrench applies said torque to the workpiece;

a user interface operatively coupled to the wrench body and having a display and having an input through which a user inputs a preset torque value;

a processor that receives the first signal, the second signal and the preset torque value;

in a first mode, compares the torque being applied to the workpiece to the preset torque value, and drives the user interface to display the torque being applied to the workpiece; and in a second mode, determines an angle of rotation based on the second signal and drives the user interface to display the torque being applied to the workpiece and the angle of rotation, wherein the processor monitors the second signal in the second mode and, based on the second signal, accumulates angular rotation of the wrench head into an angle measurement as the wrench head moves in the one rotational direction but not the opposite rotational direction, and wherein the processor monitors the first signal in the second mode and determines a peak torque during a rotational movement of the wrench head in the one rotational direction before the wrench head changes to the opposite rotational direction and, during a next rotational movement of the wrench head in the one rotational direction, begins accumulating angular rotation of the wrench head into the angle measurement only when the first signal indicates the torque applied to the workpiece is at or greater than the peak torque.

17. The electronic torque wrench of claim 16, wherein the processor monitors the second signal in the second mode and, based on the second signal, accumulates angular rotation of the wrench head into an angle measurement during a predetermined period as the wrench head moves in the one rotational direction but not the opposite rotational direction, and wherein the processor monitors the first signal in the second mode and determines a peak torque during each rotational movement of the wrench head during the predetermined period in the one rotational direction before the wrench head changes to the opposite rotational direction and, during each subsequent rotational movement of the wrench head in the one rotational direction during the predetermined period, begins accumulating angular rotation of the wrench head into the angular measurement only when the first signal indicates the torque applied to the workpiece is at or greater than the peak torque determined during an immediately preceding said rotational movement.

18. The electronic torque wrench of claim 16, wherein the first sensor comprises a strain gage.

19. The electronic torque wrench of claim 16, wherein the second sensor comprises a gyroscopic sensor.

20. An electronic torque wrench for engaging a workpiece, comprising:

a wrench body;

a wrench head in driving engagement with the wrench body, the wrench head being configured to engage the workpiece;

a first sensor operatively coupled with the wrench head and outputting a first signal, the first signal corresponding to a torque being applied to the workpiece by the torque wrench;

a second sensor operatively coupled to the wrench body and outputting a second signal, the second signal corresponding to rotation of the torque wrench about an axis of the workpiece when the torque wrench applies said torque to the workpiece;

a user interface operatively coupled to the wrench body and having a display and having an input through which a user inputs a preset torque value; and a processor that receives the first signal, the second signal and the preset torque value, and in a first mode, compares the torque being applied to the workpiece to the preset torque value, and drives the user interface to display the torque being applied to the workpiece, and in a second mode, determines an angle of rotation based on the second signal and drives the user interface to display the angle of rotation, wherein the processor monitors the second signal in the second mode and, based on the second signal, accumulates angular rotation of the wrench head into an angle measurement as the wrench head moves in one rotational direction but not an opposite rotational direction, and wherein the processor monitors the first signal in the second mode and determines a peak torque during a rotational movement of the wrench head in the one rotational direction before the wrench head changes to the opposite rotational direction and, during a next rotational movement of the wrench head in the one rotational direction, begins accumulating angular rotation of the wrench head into the angle measurement only when the first signal indicates the torque applied to the workpiece is at or greater than the peak torque.

21. The electronic torque wrench of claim 20, wherein the processor monitors the second signal in the second mode and, based on the second signal, accumulates angular rotation of the wrench head into an angle measurement during a predetermined period as the wrench head moves in the one rotational direction but not the opposite rotational direction, and wherein the processor monitors the first signal in the second mode and determines a peak torque during each rotational movement of the wrench head during the predetermined period in the one rotational direction before the wrench head changes to the opposite rotational direction and, during each subsequent rotational movement of the wrench head in the one rotational direction during the predetermined period, begins accumulating angular rotation of the wrench head into the angular measurement only when the first signal indicates the torque applied to the workpiece is at or greater than the peak torque determined during an immediately preceding said rotational movement.

* * * * *